US005216330A

United States Patent [19]

Ahonen

[11] Patent Number: 5,216,330

[45] Date of Patent: Jun. 1, 1993

[54] ION BEAM GUN

[75] Inventor: Robert G. Ahonen, Cedar, Minn.

[73] Assignee: Honeywell Inc., Minneapolis, Minn.

[21] Appl. No.: 821,394

[22] Filed: Jan. 14, 1992

[51] Int. Cl.[5] ..... H01J 27/16

[52] U.S. Cl. ..... 315/111.51; 315/111.21; 315/111.31; 315/111.81; 313/231.31; 313/359.1; 250/423 R

[58] Field of Search ..... 315/111.21, 111.31, 315/111.51, 111.81; 313/231.31, 359.1, 360.1; 250/423 R

[56] References Cited

U.S. PATENT DOCUMENTS

| | | | |
|---|---|---|---|
| Re. 32,849 | 1/1989 | Wei et al. | 204/192.27 |
| 3,084,281 | 4/1963 | Mills | 315/111.51 |
| 3,530,334 | 9/1970 | Thorpe et al. | 315/111.31 |
| 3,530,335 | 9/1970 | Thorpe et al. | 315/111.31 |
| 3,886,896 | 6/1975 | Van Cakenberghe | 313/231.31 X |
| 4,507,588 | 3/1985 | Asmussen et al. | 315/39 |
| 4,521,719 | 6/1985 | Liebel | 315/111.81 |
| 4,629,940 | 12/1986 | Gague et al. | 315/111.51 |
| 4,682,026 | 7/1987 | Douglas | 250/423 R X |
| 4,716,491 | 12/1987 | Ohno et al. | 361/230 |
| 4,818,916 | 4/1989 | Morrisroe | 315/111.21 |
| 4,826,585 | 5/1989 | Davis | 204/298 |
| 4,849,675 | 7/1989 | Muller | 315/111.51 |
| 4,851,668 | 7/1989 | Ohno et al. | 250/251 |
| 4,859,908 | 8/1989 | Yoshida et al. | 315/111.81 |
| 5,017,835 | 5/1991 | Oechsuer | 315/111.51 X |

FOREIGN PATENT DOCUMENTS 4019729 1/1992 Fed. Rep. of Germany .

OTHER PUBLICATIONS

AIAA Paper No. 69-285, "State of the Art and Recent Developments of the Radio Frequency Ion Motors", by Horst W. Loeb, Mar. 3-5, 1969.

Brochure, "The RF-Ion Source Pris 10 with the RF-Induction Coil Placed Inside the Discharge Plasma", by J. Freisinger, J. Krempel-Hesse, J. Krumeich, H. Lob, W. D. Munz, and A. Scharmann, Published by Hauzer Techno Coating, Publication date unknown.

Brochure, "RF-Ion-Sources", Published by Hauzer Techno Coating, Publication date unknown.

*Primary Examiner*—Eugene R. LaRoche
*Assistant Examiner*—Do Hyun Yoo
*Attorney, Agent, or Firm*—Ronald E. Champion

[57] ABSTRACT

The present invention discloses an ion beam gun wherein the ions are produced by radio-frequency excitation. A plasma is created in a vessel, or chamber, by ionizing gas molecules by means of a coil about the outside of the vessel. The coil receives radio-frequency energy which ionizes the gas molecules. The inside of the vessel contains an anode and resonator to assist in shaping and containing the plasma. The resonator acts as an internal electrode to produce eddy currents generated by the radio-frequency energy to enhance the plasma. A multi-apertured screen grid also helps contain and shape the plasma within the chamber while a multi-apertured accelerator grid is used to extract the ions from the ion beam gun.

29 Claims, 4 Drawing Sheets

ION BEAM GUN

TECHNICAL FIELD

This invention relates to an inductively excited ion beam gun. Specifically, the invention relates to a method and apparatus to create ions by ionizing a gas by means of a radio-frequency excited coil.

BACKGROUND OF THE INVENTION

Ion beam sources have been used for a multitude of applications from space propulsion to etching and sputter deposition of films used in semiconductors and optical films. All of these applications ionize gas molecules by removing electrons to cause the gas molecule to become a positively charged ion.

The simplest of these ionizing methods was to use a filament, or thermionic emitter, to generate electrons within the ionization chamber. The electrons created by the filament collided with the gas molecules, knocking off electrons from the gas molecules to cause the molecules to become positively charged. This method, although operable, had several disadvantages. The filaments tended to have a short life. Because the filaments were thermionic emitters and were at a negative electrical potential relative to the ionized gas, material was sputtered off of the filament which caused contamination to be introduced into the ion beam.

An improvement upon the filament type of ion generation was the introduction of a hollow cathode. This eliminated the need of a filament and greatly increased the operational life. Potentials for contamination of the ion beam due to materials present in the hollow cathode were still present.

Further advances of ion beam generating devices included using a high-frequency generator coupled to either plates or coils within the chamber to ionize the gas molecules through excitation by the high-frequency energy. These materials, especially coils within the plasma field, also created contamination in the ion beam. An advancement, placing a coil outside the gas chamber helped to eliminate this contamination. However, external magnetic fields were usually required to contain the plasma within the chamber enhancing ionization efficiency and preventing arcing from the plasma to various components within the chamber. The arcing could cause a rapid degradation of the plasma and ultimate destruction of the components within the chamber. Most of the attempts to use high-frequency plasma generation also required that the generator coil be cooled by internal water means. This introduced the problem of having each end of the coil at the same potential, preferably ground potential, to prevent the high-frequency energy from being bled off to ground. Elaborate matching networks, or tight control of the length of the waveguide, or coil, were required in order to accomplish these goals.

A need, therefore, exists for being able to generate a plasma of positively charged gas molecules without contaminating the beam by the plasma touching contaminating fixturing within the chamber and without the need of water cooled coils or external magnetic fields.

SUMMARY OF THE INVENTION

The present invention is an ion beam gun which ionizes gas molecules by exciting the gas by means of radio-frequency energy applied to an external coil. The gun has a vessel, or chamber, for containing the gas to be ionized. The vessel includes side walls, a closed first end and a second end with an aperture therethrough for extracting the ions.

A coil is wound about the outside of the side walls of the vessel and spaced apart from the side walls by means of insulating spacers. The coil has a first end and a second end. The first end is connected to ground. The second end is connected to one side of a variable capacitor, while the other side of the variable capacitor is connected to ground. Radio-frequency energy is applied to the coil at a point approximately one-third of a turn from the grounded, or first end, of the coil An RF generator supplies the energy through a matching circuit to the coil.

Inside the chamber is an anode which is connected to the first end of the chamber, or vessel. This anode has a high voltage direct current potential applied to it. At the second end of the vessel is a resonator which is a cylindrical metal plate with a hole therethrough which matches the aperture in the second end plate. This resonator is also connected to a high voltage direct current potential.

An extraction means consisting of a screen grid and an accelerator grid is located within the aperture of the second end of the vessel. The screen grid has a high voltage direct current potential applied to it. The accelerator grid has a negative direct current potential applied to it to extract the ions from the ion beam gun.

The anode has slits about the periphery to prevent eddy currents from creating electrical or magnetic fields within the anode. The resonator, however, is a complete surface and acts as a secondary electrode which does create eddy currents within the resonator.

The combination of the radio-frequency energy applied to the coil, the direct current potential applied to the anode, the resonator and the screen grid contain and stabilize the ionized gas as a plasma within the inside of the vessel.

At startup, the plasma is generated without the need of any external or internal source of electrons, such as a filament. Furthermore, there is no need for any external magnetic field or magnets to contain or shape the plasma.

It is an object of the invention to provide a high density ion source for providing positive ions of relative high energies.

It is a further object of the invention to provide an ion generating source which is relatively simple and inexpensive to construct.

Another object of the invention is to provide an ion generating source utilizing a coil and a radio-frequency generator to ionize gas molecules without the need of auxiliary magnetic fields.

It is also an object of the invention to eliminate the filament and associated beam of electrons from within the ion generating chamber to eliminate the problems associated with such filaments; such as filament burn out, filament shorting and contamination of the ion beam caused by material sputtered and evaporated off of such filaments.

These and other objects of the invention will be apparent from the following detailed description of a preferred embodiment when read in connection with the appended drawings.

DESCRIPTION OF THE PREFERRED EMBODIMENT

Figure 1:
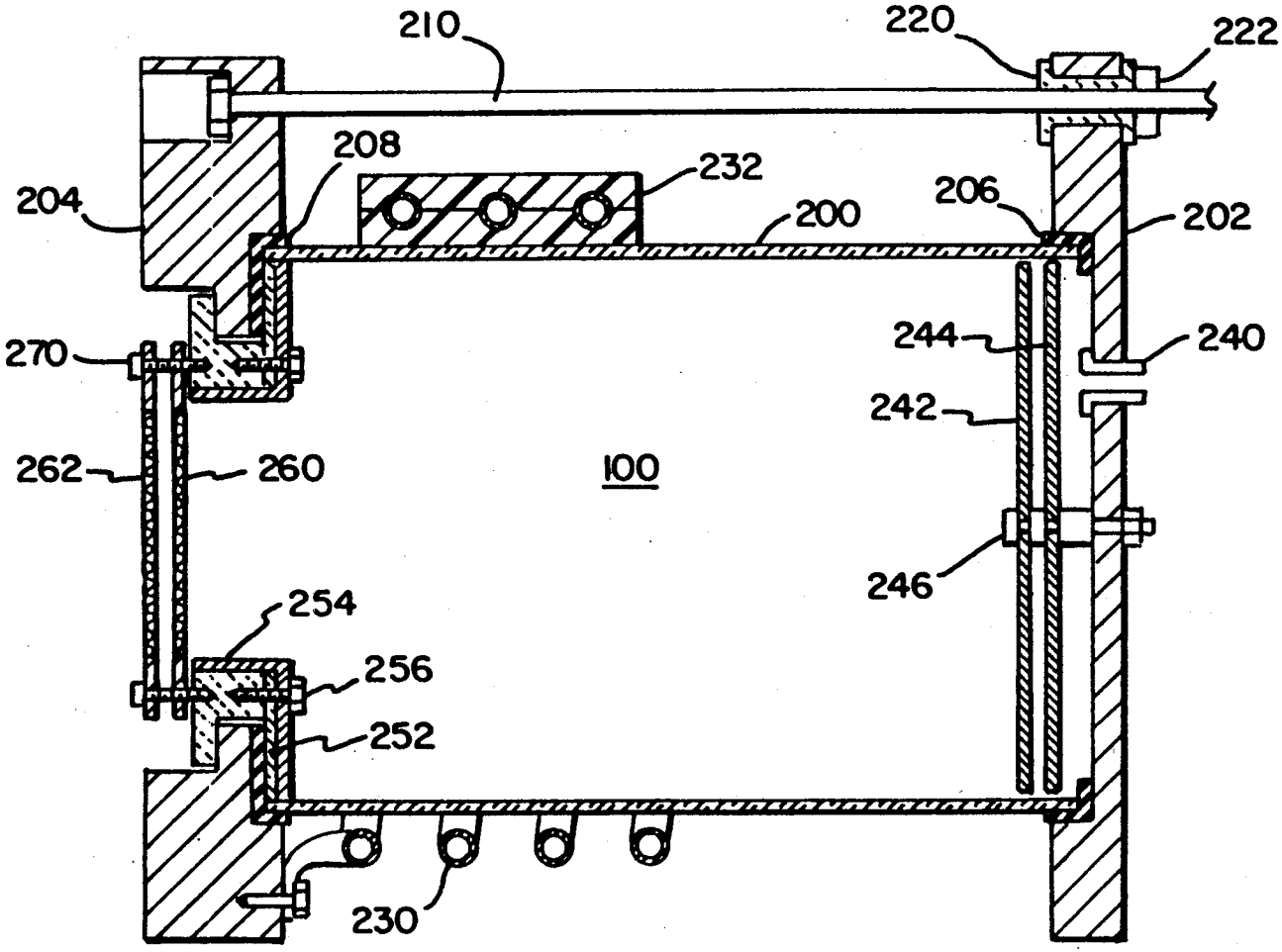
FIG. 1 is a longitudinal cross-section of the ion producing chamber of the ion beam gun of the present invention.

Referring now to FIG. 1, the ion beam gun has a chamber, or vessel, 100 for containing a gas to be ionized. The vessel 100 has side walls 200 which, in the preferred embodiment, is a high temperature cylindrical glass tube. Side wall 200 can, of course, be of any geometric shape such as square, wherein there would be side walls, or other geometric shapes. In an alternate embodiment, the side walls 200 can be made of fused quartz. It has been found, however, that utilizing a high temperature glass for side walls 200 will cut down on the ultraviolet radiation which emanates through the transparent side walls. The only requirement is that the material be a high temperature dielectric material so that it does not melt or conduct radio-frequency energy, and also be of sufficient integrity that there be minimal sputtering or loss of materials from the inside of the side walls caused by the ionized gas.

The vessel, or chamber, 100 also has a first closed end 202 made of a suitable material such as aluminum and a second end 204 having an aperture therethrough, again made of a suitable material such as aluminum. The aluminum makes an ideal material because it is conductive and it is not affected by the plasma because the plasma is shielded from the aluminum first end 202 and the second end 204 by other components within the vessel 100, as will be explained below.

A seal 206 is provided to mate between the side wall 200 and the first end 202 to form a gas-tight seal. A similar gasket 208 is designed to fit between the side wall 200 and the second end 204, again, to form a gas-tight seal. Suitable through bolts 210 connect the first side wall 202 to the second side wall 204. Because, as will be explained below, the first end 202 and the second end 204 are at different electrical potentials, it is necessary to electrically isolate through bolt 210 from first end 202. A suitable insulator 220 is provided in the first end 202 to prevent the through bolt 210 from being impressed with the electrical signals which will ultimately be placed on the first end 202. A suitable nut 222 completes the assembly to contain the side wall 200 between the first end 202 and the second end 204. A coil 230, in a preferred embodiment constructed of copper tubing, is wound about the outside of the side wall 200, but spaced apart from the side wall 200 by suitable insulators 232. A gas inlet 240 is provided in the first end 202 to allow gas to be injected into the chamber 100.

A first anode plate 242 and a second anode plate 244 are electrically and mechanically connected to a center post 246 which, in turn, is electrically and mechanically connected to the first end 202.

Adjacent to the second end 204 inside the chamber 100 is a resonator 250. Resonator 250 is, in the preferred embodiment, a flat circular titanium plate having an aperture therethrough and outstanding flange about the inside perimeter of the aperture in second end 204. The resonator 250 is electrically insulated and mechanically separated from the second end 204 by a glass insulating plate 252. The resonator 250 is mechanically attached to an insulator 254 by means of titanium screws 256. Within the aperture of the second end 204 is a multi-apertured screen grid 260 and an accelerator grid 262 which are spaced apart and held by insulating spacers 270 which attach to the insulator 254.

Figure 2:
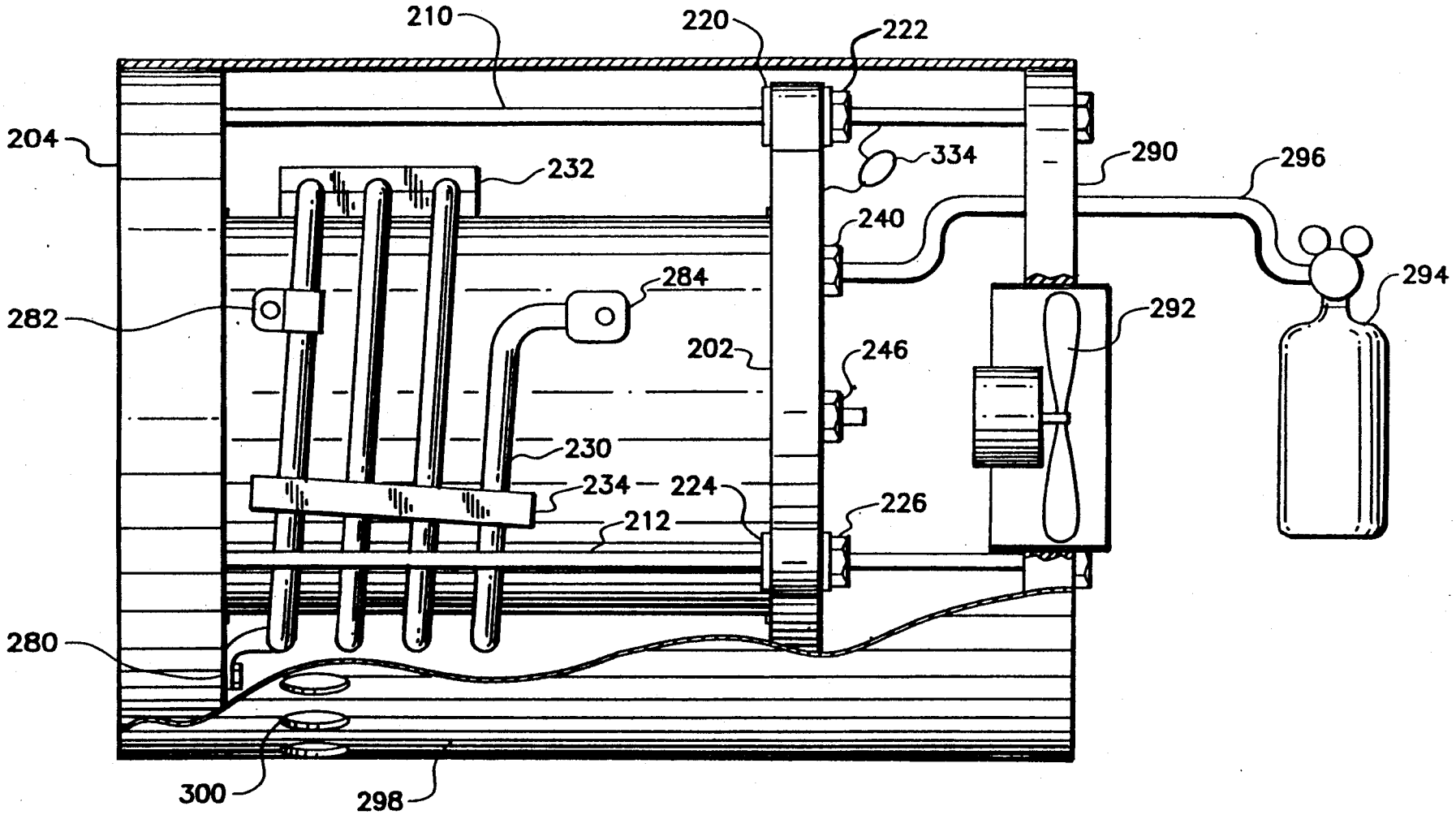
FIG. 2 is a partially cut away longitudinal view of the ion beam gun of the present invention.

Referring now to FIG. 2, an additional through bolt 212, an additional insulating spacer 221 and attachment nut 226 are shown in more detail. Similarly, an additional standoff insulator 234, similar to 232, is shown holding the coil 230.

The coil 230 is a length of conductive material wound into a solenoid of between three and four turns about the outside of vessel 100. The coil 230, in a preferred embodiment, is approximately three and one-half turns about the side walls 200 of ⅜ inch diameter thin wall copper tubing. The coil 230 has a first end 280 which, in the preferred embodiment, is attached to the second end 204 of the chamber 204 and a second end 284 which has an electrical connection which will be explained below. In addition, an intermediate point has an electrical connector 282 attached. The intermediate point is approximately one-third of a turn from the first end 280 of the waveguide.

The complete ion beam gun assembly has a fan mounting flange 290 which is spaced apart from the first end 202. The flange 290 has an aperture and a fan 292 located therein. Fan 292 forces cooling air about the ion beam gun between the outside of the side wall 200 and a metal protective shield 298. The air exits from exit holes 300 located about the periphery of the shield 298 in the area of the second end 204.

As can be seen in FIG. 2, a source of gas 294 is transmitted by means of tubing 296 to the gas inlet port 240 to be introduced into the chamber 100. In the preferred embodiment the gas is xenon. In an alternate embodiment argon has been used successfully. Any inert gas can be used as well.

Figure 3:
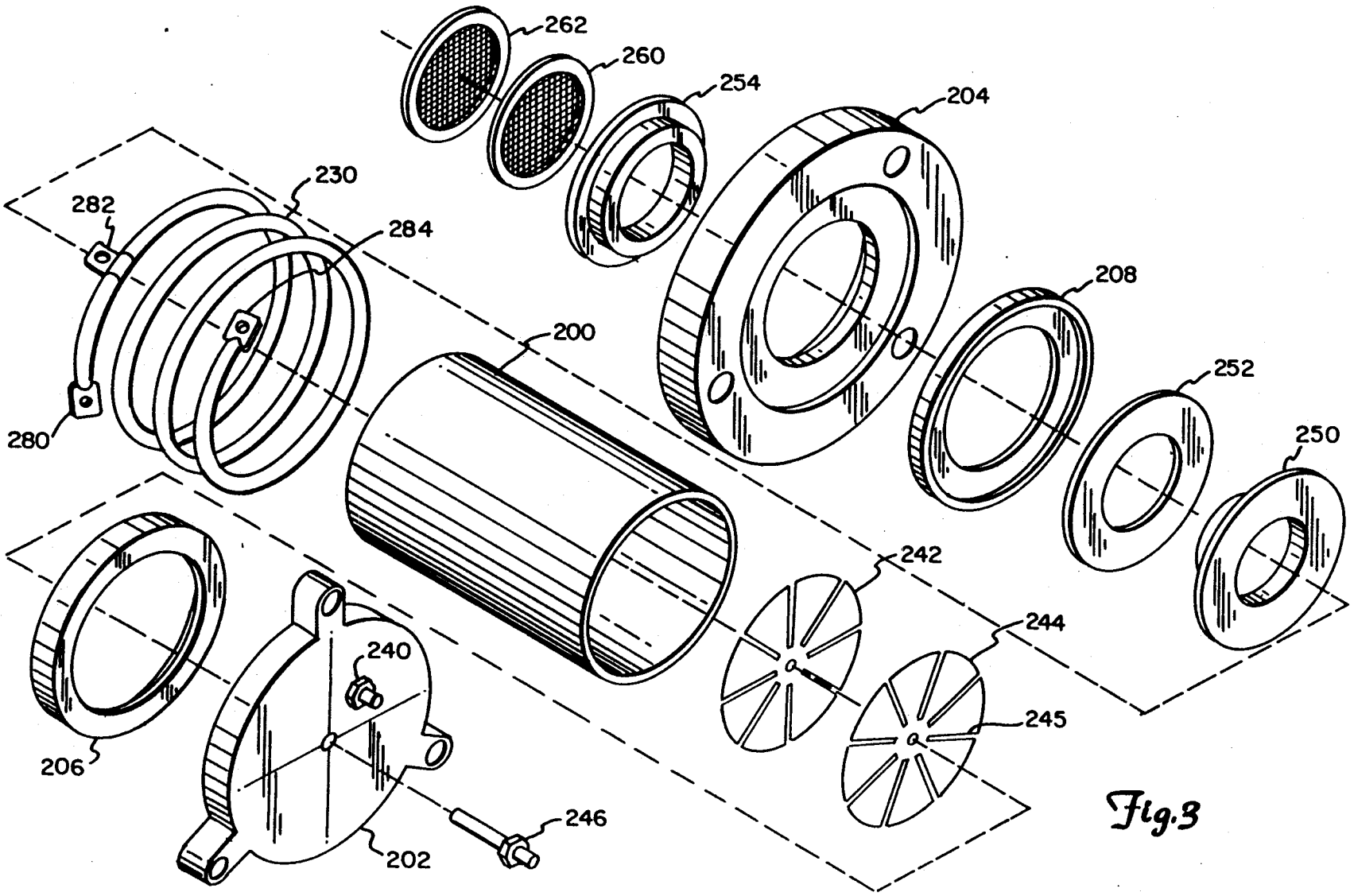
FIG. 3 is a perspective blow-up view of the components of the ion producing chamber of the ion beam gun of the present invention.

Referring now to FIG. 3, a more detailed description of the various components can be seen. In the preferred embodiment, the anode consists of two plates, a first anode plate 242 and a second anode plate 244 spaced apart and mounted on a common central post 246. The post 246 is mechanically and electrically connected to the first end plate 202 of the vessel.

The first anode plate 242 and the second anode plate 244 each have a plurality of slits 245 radiating outwardly from the center post 246 toward the perimeter of each plate. In the preferred embodiment there are eight slits in both the first anode plate 242 and the second anode plate 244. The second anode plate 244 is rotated, or orientated, on the center post 246 in such a way that the slits 245 in the first anode plate 242 do not overlap the slits 245 in the second anode plate 244. The slits prevent any eddy currents from being induced in either the first anode plate 242 or the second anode plate 244 by the radio-frequency energy impressed on the coil 230. The slits 245 also provide a gas path to uniformly disperse and diffuse the gas within the vessel.

Second anode plate 244 is spaced apart from the side wall 200 of the vessel 100 and from the first end plate 202 so that no plasma will be generated between the second anode plate 244 and the first end plate 202. Similarly, the first anode plate 242 is spaced apart from the side wall 200 and the second anode plate 244 in such a manner as to prevent a plasma from being generated between the first anode plate 242 and the second anode plate 244.

Experimentation has shown that arcing could occur from the plasma to the coil 230 through the insulating side wall 200 if the coil 230 is placed directly on the insulating side wall 200. Another problem with placing the coil 230 directly against the insulating side wall 200 is that material from the inside surface of the side wall 200 could sputter off the inside of the side wall 200, decreasing the side wall 200 strength and contaminating the ion beam with the sputtered material. Placing the coil 230 directly against side walls 200 can cause hot spots on the side walls 200 which can cause additional problems.

Spacing the coil 230 apart from the side wall 200 to provide an air gap between the coil 230 and the side wall 200 minimizes all of these problems. The coil 230, in the preferred embodiment, is spaced apart from the side wall 200 by means of a plurality of insulating spacers, such as spacer 232 and spacer 234. This not only prevents arcing, contamination and sputtering of the side wall 200, but also provides an air path between the coil 230 and the side wall 200 to allow cooling air from the fan 292 to further cool the coil 230 and the surface of the side wall 200.

Again, referring to FIG. 3, more specific detail of screen grid 260 and accelerator grid 262 can be seen. The screen grid 260 has a plurality of apertures. These apertures are holes approximately 0.075 inches in diameter and having a density of approximately 100 holes per square inch. The accelerator grid 262, similarly, has a plurality of apertures. These apertures are approximately 0.050 inches in diameter and have a density of approximately 100 holes per square inch. Both the screen grid 260 and the accelerator grid 262 are, in the preferred embodiment, constructed out of a graphite material. The apertures in the screen grid 260 and the apertures in the accelerator grid 262 are aligned one to the other.

Figure 4:
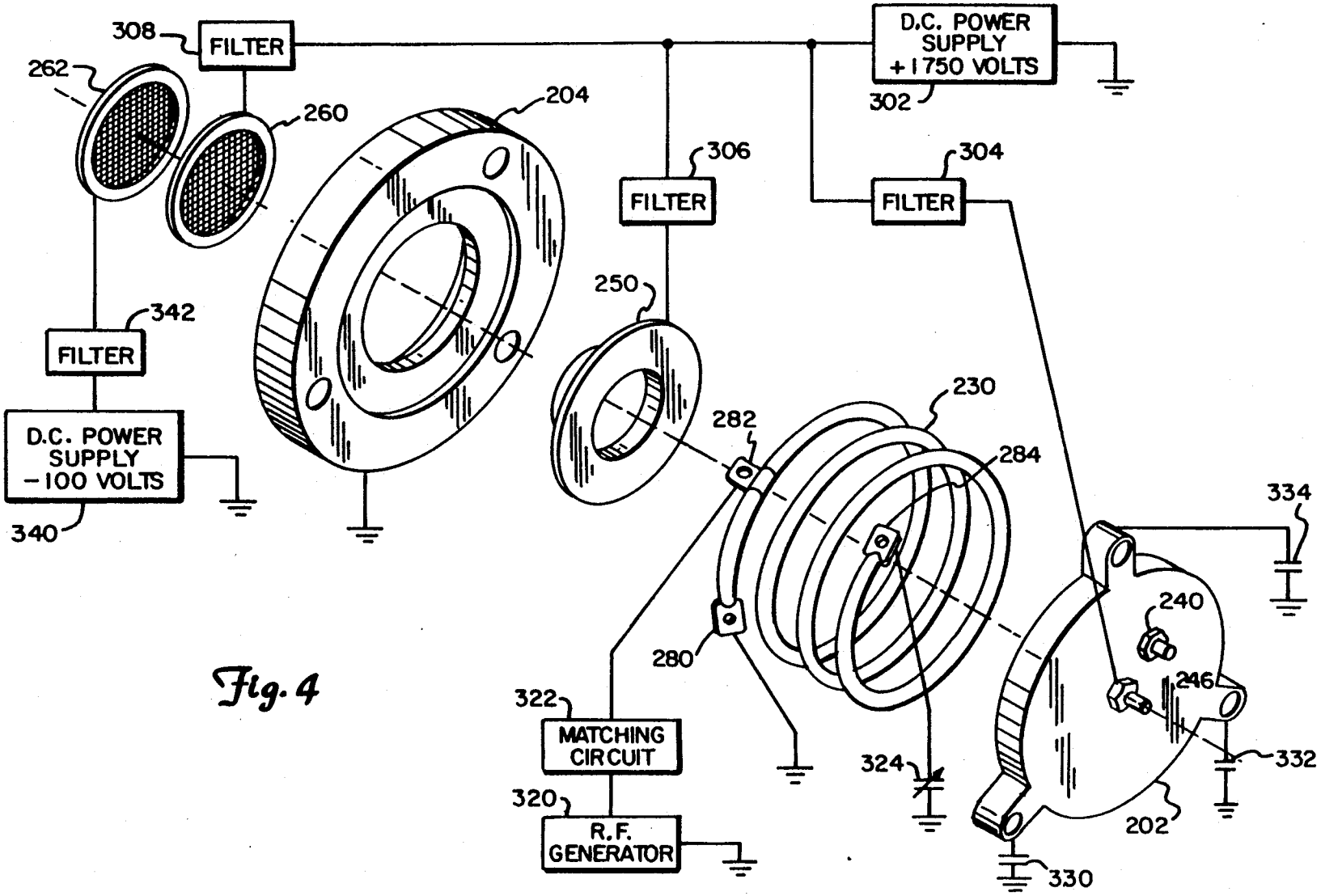
FIG. 4 is an electrical block diagram showing the electrical components and their interconnection to the components of the ion producing chamber of the ion beam gun of the present invention.

Referring now to FIG. 4, the electrical interconnection of the various components to the ion beam gun can be seen in detail. A direct current power supply 302, which is adjustable between approximately 1000 volts and 2000 volts, is provided to supply electrical potential through filter 304 to the first end 202 of the ion beam gun through an electrical connection to the center post 246. Power supply 302 also supplies its voltage through a filter 306 to the resonator 250. Similarly, the same voltage is applied through filter 308 to the screen grid 260. This positive DC potential, which in the preferred embodiment, has been found to be effective at 1750 volts. The power supply 302 is a second power supply.

The radio-frequency generator 320 can supply energy having a frequency which is variable between 6 megahertz to 50 megahertz and power between a few watts to several hundred watts. The radio-frequency generator 320, in the preferred embodiment, outputs a standard industrial frequency of 13.56 megahertz. The radio-frequency energy is sent through a matching circuit 322 and connected to the intermediate point 282 of the coil 230. The first end of the coil 230 is connected to the second end plate 204 which is grounded and, therefore, the first end of the coil 230 is at ground potential. The second end 284 of the coil 230 is connected to a first end of a variable capacitor 324, which is variable between the range of 5 microfarads to 100 microfarads. A second end of variable capacitor 324 is connected to ground.

A plurality of capacitors 330, 332 and 334, typically 0.01 picofarad capacitors, have their first end connected to the first end 202. A second end of capacitors 330, 332, and 334 is connected to ground. In the preferred embodiment, as shown in FIG. 2, this connection is made through the through bolts, such as through bolt 210. Capacitors 330, 332 and 334 drain off any induced radio-frequency charge that would be induced in the first end 202 by the radio-frequency energy supplied to coil 230. It should be noted that the RF energy supplied to coil 230 does induce eddy currents in resonator 250. It has been found that the inducing of the eddy currents in resonator 250 increases the beam strength of the output beam of the ion beam gun by approximately 20% when used in conjunction with the capacitors 330, 332 and 334. A third power supply 340 supplies a negative DC potential through filter 342 to the accelerator grid 262. This extracts the ions from inside chamber 100 to be used for the purposes intended.

It has been found that by using an input wattage from the RF generator of approximately 550 watts that an output beam of 1750 volts at 200 milliamperes of current can be achieved.

OPERATION

In operation, the ion beam gun is attached to a vacuum chamber (not shown) in which is placed the equipment upon which the ions will impinge. A seal is placed between the outside vacuum chamber walls and the second end 204 of the vessel to make a gas-tight seal.

A supply of argon or xenon gas is supplied from gas source 294 into the inside of chamber 100 at a flow of 3.5 standard cubic centimeters per minute. The gas is diffused through slots 245 in second anode plate 244, and slots 245 in the first anode plate 242 and about the perimeter of anode plates 242 and 244 to uniformly disperse within the chamber 100.

The coil 230 is supplied with radio-frequency energy from the first power supply or radio-frequency generator 320 through matching circuit 322. The frequency of the RF generator 320 is, in the preferred embodiment 13.56 megahertz with an output power of 550 watts. The matching circuit 322 matches the output impedance of the radio-frequency generator to a transmission line impedance of 50 ohms. The transmission line from the matching circuit 322 is connected at an intermediate point 282 on coil 230 so that the impedance from the intermediate point 282 to ground is near 50 ohms when the plasma is generated and operating.

The first end 202 and, subsequently, the anode plates 242 and 244 are supplied with 1750 volts from the second power supply 302. The second power supply also supplies 1750 volts to the resonator 250 and the screen grid 260.

The ions thus generated are extracted from the vessel 100 by applying a second direct current voltage, which in the preferred embodiment is a negative 100 volts (between −50 VDC and −200 VDC), from the third power supply 340 to accelerator grid 342. In the preferred embodiment, the output from the ion beam gun has been measured to be 200 milliamperes at 1750 volts.

Having illustrated and described the principles of the invention in a preferred embodiment, it should be apparent to those skilled in the art that the invention can be modified in arrangement and detail without departing from such principles. I claim all modifications coming within the spirit and scope of the following claims.

I claim:

1. An ion beam gun comprising:

a) a vessel having an inside, an outside, side walls, a first end and a second end, for containing a gas to be ionized;

b) a coil spaced apart from the outside of said vessel;

c) a high-frequency generator connected to said coil for introducing radio-frequency energy into said coil to ionize said gas within the inside of said vessel into positively charged ions and electrons which form a plasma;

d) a resonator within said vessel adjacent to said second end of said vessel for generating eddy currents by being excited by said radio-frequency energy from the coil thereby enhancing said plasma;

e) an extraction means for removing said positively charged ions from said vessel; and f) an anode located within said vessel adjacent to said first end of said vessel.

2. An ion beam gun as recited in claim 1 wherein said extraction means includes an accelerator grid having a negative direct current voltage applied thereto.

3. An ion beam gun as recited in claim 1 wherein said resonator is an electrode for receiving the radio-frequency from said radio-frequency excited coil.

4. An ion beam gun as recited in claim 3 wherein said resonator is made of titanium.

5. An ion beam gun as recited in claim 1 wherein said coil is a continuous coil of approximately three and one-half turns, said coil having a first end, a second end and an intermediate point, said intermediate point of said coil being approximately one-third of a turn from said first end of said coil and said first end of said coil electrically connected to ground potential, said second end of said coil connected to a variable capacitor, and said intermediate point of said coil connected to said high-frequency generator.

6. An ion beam gun as recited in claim 5 wherein said coil is constructed of copper tubing.

7. An ion beam gun as recited in claim 1 wherein said side walls of said vessel are a high temperature glass.

8. An ion beam gun as recited in claim 1 wherein said side walls of said vessel are fused quartz.

9. An ion beam gun comprising:

a) a vessel having side walls, a closed first end and a second end, said second end having an aperture therethrough;

b) a supply means for providing a gas to be ionized;

c) a gas inlet means for introducing said gas from said supply means into said vessel through said first end of said vessel;

d) a gas diffusion means for uniformly distributing said gas within said vessel;

e) a coil having a first end connected to ground, an intermediate point, and a second end, said coil spaced apart from and wound about the side walls of said vessel;

f) a first power supply connected to said intermediate point of said coil for supplying radio-frequency energy to said coil for ionizing said gas into a plasma within said vessel;

g) a variable capacitor having a first end connected to said second end of said coil and a second end connected to ground;

h) an anode located within said vessel adjacent to said first end of said vessel;

i) a second power supply connected to said anode to supply a first direct current voltage to said anode;

j) a first suppression means associated with said anode for preventing eddy currents from being generated in said anode by the radio-frequency energy supplied through said coil;

k) a second suppression means associated with said first end of said vessel for removing radio-frequency induced voltages from said first end of said vessel;

l) a resonator within said vessel adjacent said second end of said vessel, said resonator having an aperture therethrough aligned with the aperture in said second end of said vessel, said resonator electrically connected to said second power supply;

m) a multi-apertured screen grid located outside said vessel, adjacent to said aperture in said second end of said vessel, said screen grid electrically connected to said second power supply;

n) a multi-apertured accelerator grid located outside said vessel adjacent to said screen grid; and o) a third power supply connected to said accelerator grid to supply a second direct current voltage to said accelerator grid to accelerate said ionized gas out of said vessel.

10. An ion beam gun as recited in claim 9 wherein said gas in an inert gas.

11. An ion beam gun as recited in claim 10 wherein said inert gas is argon or xenon.

12. An ion beam gun as recited in claim 9 wherein said side walls are constructed of an insulating material.

13. An ion beam gun as recited in claim 12 wherein said insulating material is a high temperature glass.

14. An ion beam gun as recited in claim 12 wherein said insulating material is fused quartz.

15. An ion beam gun as recited in claim 9 wherein said anode comprises a pair of anode plates and said gas diffusion means includes said pair of anode plates spaced apart from one another, each of said anode plates having a plurality of slots therein radiating toward the perimeter of each plate to form a path for said gas.

16. An ion beam gun as recited in claim 9 wherein said coil is formed of a length of copper tubing wound in a solenoid about the side walls of said vessel to form between three and four turns.

17. An ion beam gun as recited in claim 16 wherein said coil is three and one-half turns about said side walls of said vessel.

18. An ion beam gun as recited in claim 17 wherein said intermediate point of said coil is one-third of a turn from said first end of said coil.

19. An ion beam gun as recited in claim 9 wherein said first power supply provides radio-frequency energy having a frequency between 6 megahertz and 50 megahertz.

20. An ion beam gun as recited in claim 9 wherein said second power supply provides a positive direct current voltage of between 1000 volts DC and 2000 volts DC.

21. An ion beam gun as recited in claim 9 wherein said third power supply supplies a negative direct current voltage of between −50 volts DC and −200 volts DC.

22. An ion beam gun as recited in claim 9 wherein said variable capacitor is variable between 5 microfarads and 100 microfarads.

23. An ion beam gun as recited in claim 9 wherein said anode comprises a first anode plate and a second anode plate and said first suppression means is a plurality of slits radiating outwardly from said first anode plate and a plurality of slits radiating outwardly from said second anode plate to prevent eddy currents from being impressed on either anode plate by said radio-frequency energy.

24. An ion beam gun as recited in claim 9 wherein said second suppression means is a plurality of capacitors connected between said first end of said vessel and ground.

25. An ion beam gun as recited in claim 9 wherein said resonator is a metal plate which acts as an internal electrode for generating eddy currents by being excited by said radio-frequency energy.

26. A ion beam gun as recited in claim 25 wherein said metal plate is made of titanium.

27. An ion beam gun as recited in claim 9 wherein said screen grid is a perforated graphite plate.

28. An ion beam gun as recited in claim 9 wherein said accelerator grid is a perforated graphite plate.

29. A method of generating ions comprising the steps of:

a) providing a gas to be ionized to form a plasma;
b) providing a vessel having side walls, a first end and an apertured second end, to contain said gas to be ionized;
c) providing a coil about the side walls of said vessel;
d) introducing a radio-frequency signal having radio-frequency energy into said coil;
e) providing an anode adjacent to said first end of said vessel;
f) providing a resonator adjacent to said second end of said vessel;
g) providing a multi-apertured screen grid in said aperture of said second end of said vessel;
h) introducing said gas into said vessel;
i) ionizing said gas into said plasma by said radio-frequency energy from said coil without additional magnetic fields;
j) supplying a first direct current voltage to said anode, said screen grid and said resonator to contain and shape said plasma;
k) allowing eddy currents to be induced in said resonator by being excited by said radio-frequency energy to enhance said plasma;
l) placing a multi-apertured accelerator grid adjacent to said screen grid outside said vessel; and
m) placing a negative direct current voltage on said accelerator grid to extract ions from said vessel.

* * * * *